US009373490B1

(12) United States Patent
Nishiguchi et al.

(10) Patent No.: US 9,373,490 B1
(45) Date of Patent: Jun. 21, 2016

(54) TIME-OF-FLIGHT MASS SPECTROMETER

(71) Applicant: SHIMADZU CORPORATION, Kyoto-shi, Kyoto (JP)

(72) Inventors: Masaru Nishiguchi, Kyoto (JP); Daisuke Okumura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/744,112

(22) Filed: Jun. 19, 2015

(51) Int. Cl.
*H01J 49/40* (2006.01)

(52) U.S. Cl.
CPC ..... *H01J 49/401* (2013.01); *H01J 49/403* (2013.01)

(58) Field of Classification Search
CPC ... H01J 49/401; H01J 49/004; H01J 49/4225; H01J 49/062; H01J 49/063; H01J 49/40; H01J 49/422; H01J 49/424; H01J 49/427
USPC ..... 250/287, 281, 282, 286, 292, 293, 295
See application file for complete search history.

(56) References Cited

U.S. PATENT DOCUMENTS 5,654,543 A * 8/1997 Li ..... H01J 49/488 250/282
6,683,301 B2 * 1/2004 Whitehouse ..... B82Y 30/00 250/287
6,903,332 B2 * 6/2005 Weiss ..... H01J 49/401 250/281
7,034,292 B1 * 4/2006 Whitehouse ..... H01J 49/004 250/281
7,208,726 B2 * 4/2007 Hidalgo ..... H01J 49/401 250/281
7,582,864 B2 * 9/2009 Verentchikov ..... H01J 49/004 250/281
8,013,290 B2 * 9/2011 Rather ..... H01J 49/004 250/281
8,247,769 B2 * 8/2012 Zewail ..... H01J 37/22 250/306
8,686,359 B2 * 4/2014 Zewail ..... H01J 37/22 250/306
2001/0030284 A1 * 10/2001 Dresch ..... H01J 49/401 250/287
2008/0156980 A1 * 7/2008 Rather ..... H01J 49/004 250/287
2010/0123073 A1 * 5/2010 Guest ..... H01J 49/0045 250/282

FOREIGN PATENT DOCUMENTS

GB 2 386 751 A 9/2003
JP 4649234 B2 3/2011
WO 01/11660 A1 2/2001

* cited by examiner

*Primary Examiner* — David A Vanore
(74) *Attorney, Agent, or Firm* — Sughrue Mion, PLLC

(57) ABSTRACT

When ions introduced between repeller electrode and extraction electrode are accelerated through flight space, orthogonal acceleration power supply portion applies a designated voltage to a plurality of acceleration electrodes in such a way as to form an acceleration field wherein potential distribution $\phi$ along central axis of the acceleration area becomes $\partial^2\phi/\partial Z^2<0$. When ions traverse an acceleration field with this manner of axial potential distribution, in addition to force in the acceleration direction, force pressing towards central axis acts on ions situated away from central axis. This causes ions to be fired through flight space while being focused, and hence to reach detector more efficiently. This makes it possible to improve measurement sensitivity without adding a focusing lens or the like.

3 Claims, 4 Drawing Sheets

TIME-OF-FLIGHT MASS SPECTROMETER

TECHNICAL FIELD

The present invention relates to a time-of-flight mass spectrometer (hereinafter abbreviated "TOFMS"), and more specifically to an orthogonal acceleration (OA) type TOFMS.

BACKGROUND ART

In a TOFMS, ions originating from a sample compound are made to fly over a fixed distance by being granted fixed kinetic energy, the time required for this flight is measured, and the mass-to-charge ratio of the ion is found from said flight time. For this reason, if there is variation in the position of the ion or the initial energy of the ion when the ion is being accelerated to begin its flight, this will produce variation in flight time for ions of the same mass-to-charge ratio, leading to a decline in mass resolution and mass accuracy. One known method of overcoming this issue is to use an orthogonal acceleration (also called "vertical acceleration" or "orthogonal extraction") type TOFMS.

In an orthogonal acceleration-type TOFMS, an ion beam originating from a sample is accelerated in a pulse in a direction orthogonal to the direction of progress, and ion packets produced thereby are sent into a flight space where mass spectrometry is performed. Performing acceleration in an orthogonal direction suppresses variation in the initial speed of ions in the direction of acceleration, making it possible to significantly reduce turnaround time occurring during ion acceleration, in turn making it possible to improve mass resolution. In recent years, so-called Q-TOF devices capable of high-accuracy, high-resolution MS/MS analysis, which are equipped with a highly ion-selective quadrupole mass filter around the collision cell in the stage prior to the orthogonal acceleration-type TOFMS, with its high mass resolution and mass accuracy, have come to be widely used to perform proteome analysis, etc.

FIG. 4 is a schematic structural drawing of the orthogonal acceleration portion of a common prior-art orthogonal acceleration-type TOFMS.

Orthogonal acceleration portion 1 includes flat repeller electrode 11 provided parallel to the direction of progress of the introduced ion beam (X axis direction), extraction electrode 12 provided opposite repeller electrode 11 across from the ion beam, and a plurality of acceleration electrodes 13 (13*a*, 13*b*) that together form the acceleration area in which ions extracted by the repeller electrode 11 and extraction electrode 12 are accelerated. Among these, extraction electrode 12 and acceleration electrode 13*b* in the final stage of the acceleration region comprise a grid electrode in which a conductive grid is spread over the aperture traversed by ions (see Non-patent Literature 1).

In this orthogonal acceleration portion 1, an ion beam originating from a sample compound is introduced in the X axis direction into the extraction area between repeller electrode 11 and extraction electrode 12, as indicated in FIG. 4. At this time, electrodes 11 and 12 have the same potential (for example, ground potential), so there is no electric field in the extraction area or the acceleration area. At a designated point in time when an adequate quantity of ions have been introduced, a high-voltage pulse of the same polarity as the ion is applied to repeller electrode 11, and voltage serving to accelerate the ion is applied to extraction electrode 12 and acceleration electrode 13 along the Z axis direction. The magnetic field formed by the voltage applied in this way causes part of the ion beam to be deflected from the extraction area towards the acceleration area, upon which major kinetic energy applied thereto by the accelerating field causes it to traverse the grid aperture of the final-stage acceleration electrode 13*b* and be discharged as an ion packet. Although the accelerating field accelerates the ion in the Z axis direction, because the initial speed of the ion is in the X axis direction (drift direction), the actual direction at the start of flight will be in the direction indicated by the outline arrow in FIG. 4.

The reason for using a grid electrode for both the extraction electrode 12 and the acceleration electrode 13*b* is to delimit the border of the potential while ions are made to traverse at a designated transmission efficiency in order to form a uniform accelerating field in the acceleration area. However, when the ions traverse the grid electrode, a fixed proportion of the ions disappear upon coming in contact with the grid, rendering unavoidable a commensurate loss in signal sensitivity. Furthermore, diverging lens effect is produced by leaks in the electric field through microscopic openings in the grid, causing a portion of the diverging ions to not be injected, further reducing sensitivity, which runs the risk of reducing resolution or accuracy due to a decline in optical characteristics such as time convergence at the point in time of arrival at the detector.

To overcome this drawback that exists in the event of the use of a grid electrode, orthogonal acceleration-type TOFMS not using a grid electrode has also been proposed (see Patent Literature 1, 2, etc.). However, devices of this kind require the addition of hardware such as electrodes pulse-driven at a designated timing as well as advanced and complicated controls, which makes considerable cost increase unavoidable.

Another device has been proposed wherein a focusing electrode is provided in the extraction area between the repeller electrode and the extraction electrode in order to compress the ion packet in the drift direction and thereby make it possible to use a detector with a small ion detection surface (see Patent Literature 3). However, because this device, like the aforesaid prior art, uses a grid electrode in the final stage of the extraction electrode and the acceleration electrode, it is difficult to achieve a high ion transmission efficiency. Furthermore, focusing electrodes must be added anew, but in actual fact, it is difficult to provide focusing electrodes within the narrow extraction area between the repeller electrode and the extraction electrode in such a way as to exert an adequate electric field.

PRIOR ART LITERATURE

Patent Literature (Patent literature 1) UK Patent Publication No. 2386751, specification (Patent literature 2) International Publication No. 2001/0011660

(Patent literature 3) Japanese Patent Publication No. 4649234

Non-Patent Literature (Non-patent literature 1) M. Guilhaus and 2 others, "Orthogonal Acceleration Time-of-flight Mass Spectrometry", Mass Spectrom. Rev., Vol. 19, 2000, p. 65-107

(Non-patent literature 2) Kato, "Introduction to Electron Optics—For a better understanding of the electron spectrometer—(Ed. 4 Journal of Surface Analysis Vol. 12 No. 1 (2005) pp. 24-45), Dec. 6, 2013, internet <URL: http://www.sasj.jp/JSA/CONTENTS/vol.12_1/Vol.12%20No.1/Vol.12%20No.1%2024-45.pdf>

SUMMARY OF THE INVENTION

Problem to be Solved by the Invention

The present invention was devised with a view to overcoming the aforesaid problem, having as its primary objective to provide an orthogonal acceleration-type time-of-flight mass spectrometer that is able to achieve high ion transmission efficiency by means of simple electrode structure and controls, thereby rendering possible a high level of sensitivity and precision while avoiding an increase in cost.

Another objective of the present invention is to provide an orthogonal acceleration-type time-of-flight mass spectrometer that, depending on factors such as the objective of analysis, is able to switch between high-resolution measurement that maintains adequate sensitivity but is focused in particular on mass resolution, and high-sensitivity measurement that provides adequate resolution but is focused in particular on measurement sensitivity.

Means of Solving the Problem

In order to solve the aforesaid problem, the present invention is an orthogonal acceleration-type time-of-flight mass spectrometer furnished with an orthogonal acceleration portion that accelerates ions introduced therein in a direction orthogonal to the optical axis of the ion beam, characterized in that the orthogonal acceleration portion is furnished with:

a) a repeller electrode provided parallel to the optical axis of the ion beam;

b) an extraction electrode provided opposite said repeller electrode across from the ion beam, which serves as a grid electrode;

c) a plurality of ring or cylindrical acceleration electrodes that together form the acceleration field that serves to accelerate ions traversing the grid of said extraction electrodes in a direction orthogonal to the optical axis of the aforesaid ion beam by means of the electric field formed between the aforesaid repeller electrode and the aforesaid extraction electrode; and d) a voltage input portion that, towards the aim of producing focusing action on the ions in a direction orthogonal to the direction of acceleration, inputs to each of the aforesaid plurality of acceleration electrodes a voltage determined to form, over at least a portion of the aforesaid acceleration field, an electric field in which the declining gradient of the potential distribution along the central axis of the aforesaid plurality of acceleration electrodes increases gradually in the direction of progress of the ions.

In a conventional prior-art orthogonal acceleration-type TOFMS, the voltage applied to the acceleration electrode was set in such a way that the axial potential distribution in the direction of progress of ions in the acceleration field of the orthogonal acceleration portion formed a linear declining gradient. In short, in this case, the acceleration field becomes a uniform electric field, so the ions do not incur force in the diameter direction of the acceleration field (the direction orthogonal to the acceleration direction).

In contrast, in the TOFMS in the present invention, the voltage applied to each acceleration electrode is set in such a way that the potential distribution on central axis Z of the acceleration electrode, i.e. axial potential distribution $\phi$, attains $\partial^2\phi/\partial Z^2<0$ within a range of at least a portion of the acceleration field. This is axial potential distribution in which the downwards gradient increases gradually. As is well known, spatial potential distribution is determined by Laplace's equation, but according to the provisions of Laplace's equation in an axisymmetric coordinate system, when $\partial^2\phi/\partial Z^2<0$, there is a positive component in the radial direction orthogonal to the central axis Z that cancels out this change in potential distribution. For this reason, the electric field at this time exerts force on ions positioned away from central axis Z in the radial direction towards central axis Z. For this reason, ion packets traversing the acceleration field incur force towards the center, i.e. force focusing the spread of ions, over at least a portion of this acceleration field, causing ions to be fired towards the flight space in a centrally focused trajectory.

In other words, this can be interpreted to mean that the acceleration electrode of the TOFMS in the present invention, which accelerates the ions in the orthogonal acceleration portion, itself serves the function of an ion-focusing lens. This makes it possible to efficiently fly ions into the detector without needing to provide grid electrodes at the final stage of the plurality of acceleration electrodes, as in the prior art, and without adding a lens electrode for additional focusing along with a voltage supply for the same.

Moreover, when not using grid electrodes in the final stage of the acceleration electrode, axial potential is produced in such a way that $\partial^2\phi/\partial Z^2>0$ due to electric field leakage in the vicinity of the entrance aperture thereof. For this reason, lens action that diffuses the ions occurs in this area. However, it is merely necessary to adjust the axial potential distribution in such a way as to provide focusing action greater than the aforesaid diffusion action in the acceleration area prior to the ions reaching this area, so that the focusing action outweighs the diffusion action, to make it possible to compress the ion packet in the drift direction thereof (the direction of progress of the ion beam into which ions are introduced between the repeller electrode and the extraction electrode).

Although focusing the ions in the acceleration field in the manner set forth above increases the amount of ions reaching the detector, doing so runs the risk of lowering mass resolution, etc., as depending on the original position of the ions, this can change the flight distance, albeit slightly.

Hence, in the time-of-flight mass spectrometer in the present invention, towards the aim of adjusting the action of focusing ions in the acceleration field in a direction orthogonal to the direction of acceleration, it is preferable to additionally provide a controller to control the aforesaid voltage application portion in such a way as to alter the voltage applied to each of the aforesaid plurality of acceleration electrodes.

Furthermore, even more preferably, the time-of-flight mass spectrometer in the present invention is able to switch between high-resolution measurement mode prioritizing mass resolution and high-sensitivity measurement mode prioritizing sensitivity, as the aforesaid controller is disposed such that, when high-sensitivity measurement mode is specified, voltage is input to each of the aforesaid plurality of acceleration electrodes in such a way as to form, over at least a portion of the aforesaid acceleration field, an electric field in which the downwards gradient of the potential distribution along the central axis of the aforesaid plurality of acceleration electrodes increases gradually in the direction of progress of the ions, and when high-resolution measurement mode is specified, voltage is input to each of the plurality of acceleration electrodes in such a way as to achieve an electric field in which the potential gradient of the aforesaid potential distribution is uniform.

With this configuration, when high-sensitivity measurement mode is specified, ion packet focusing is performed in the acceleration region, as stated above, causing ions to reach the detector at low loss. This renders possible measurement at particularly high sensitivity. In contrast, when high-resolution measurement mode is specified, a uniform acceleration field is formed in the acceleration region, as in the prior art. This causes ions ejected from the orthogonal acceleration portion to proceed while spreading, so a portion of ions to not reach the detector, resulting in lower sensitivity than high-sensitivity measurement mode. On the other hand, this uniformizes the length of the flight distance of ions of the same type reaching the detector, resulting in higher resolution than high-sensitivity measurement mode.

According to this configuration, because control by the controller enables rapid switching between high-sensitivity measurement mode and high-resolution measurement mode, it is possible to switch between high-resolution measurement and high-sensitivity measurement within the relatively short time during which a particular component fractionated by, e.g., liquid chromatography, is introduced, and obtain results (mass spectrum) for each measurement.

Effect of the Invention

According to the time-of-flight mass spectrometer in the present invention, there is no need to use the grid electrodes provided at the final stage of the plurality of accelerating electrodes, which makes it possible to commensurately reduce ion loss due to the grid electrodes, and hence launch ions more efficiently at the detector. Furthermore, there is no need to provide anew an ion-focusing lens electrode for the purpose of focusing the ions, nor a voltage supply for the same, which makes it possible to increase the sensitivity of measurement while suppressing cost increases. Furthermore, ion packets can be launched into the detector with their width compressed, making it possible to reduce the size of the ion detection surface required to obtain the same measurement sensitivity. This makes it possible not only to keep down the cost of the detector, but also makes it possible to use a detector with better performance in terms of time responsivity and the like.

Furthermore, according to the preferred embodiment of the time-of-flight mass spectrometer in the present invention, when one wishes to perform high-sensitivity measurement focused on measurement sensitivity, for example to perform quantitative analysis of trace elements, measurement can be performed at low mass resolution but at an adequately higher sensitivity than in the case of high-resolution measurement focused on mass resolution. Conversely, when one wishes to perform high-resolution measurement focused on mass resolution, e.g. for qualitative analysis of components contained in comparatively greater quantity, measurement can be performed at low sensitivity but at an adequately higher mass resolution than in the case of high-sensitivity measurement. Thus, measurement can be clearly switched between sensitivity-focus and mass resolution-focus, making it possible to obtain accurate results according to the objective of analysis.

DETAILED DESCRIPTION OF THE EXEMPLARY EMBODIMENTS

Figure 1:
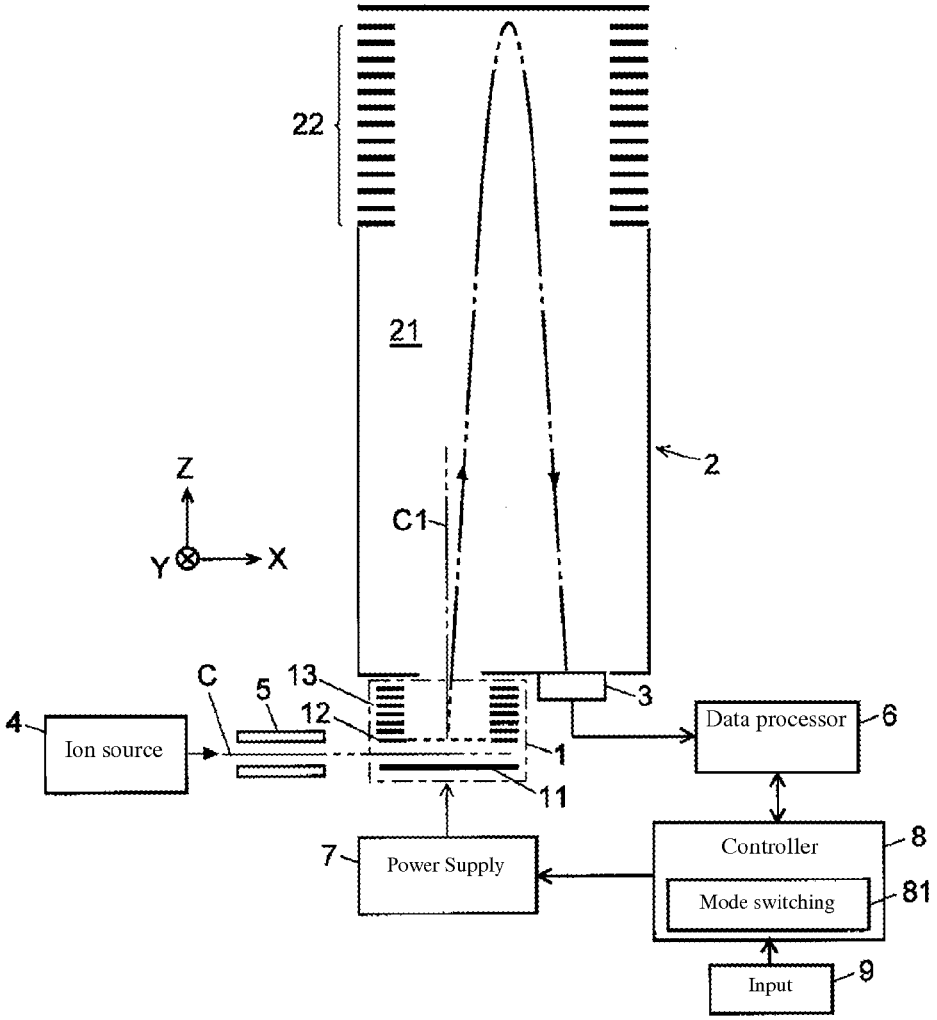
FIG. 1 Overall configuration of orthogonal acceleration-type TOFMS in an embodiment example of the present invention.
Figure 2:
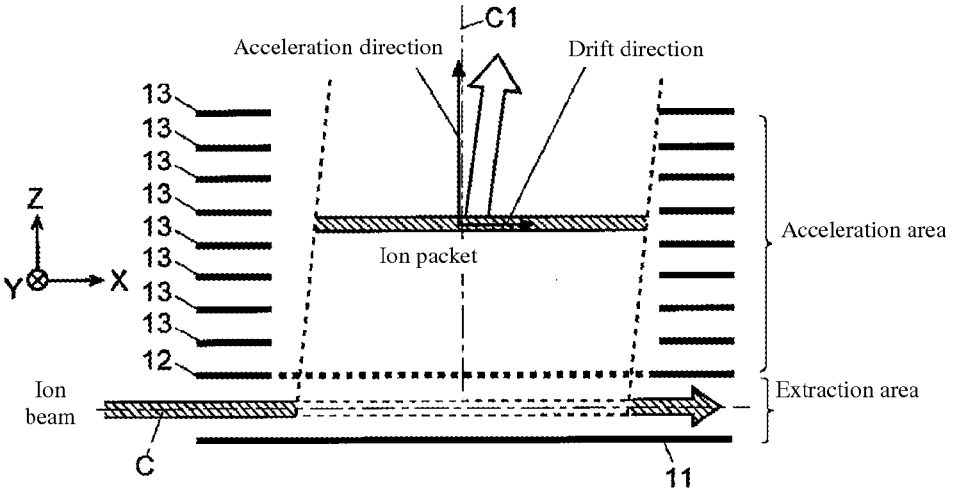
FIG. 2 Configuration of the orthogonal acceleration portion of the orthogonal acceleration-type TOFMS in the present embodiment example.
Figure 4:
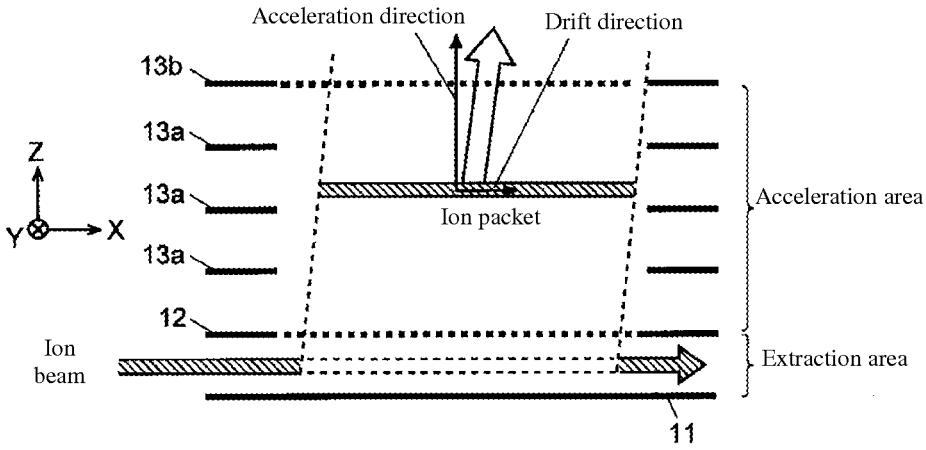
FIG. 4 Configuration of the orthogonal acceleration portion of a prior-art orthogonal acceleration-type TOFMS.

An embodiment example of the orthogonal acceleration-type TOFMS in the present invention will be described referencing the attached drawings. FIG. 1 shows the overall configuration of the orthogonal acceleration-type TOFMS in the present embodiment example, and FIG. 2 shows the configuration of the orthogonal acceleration portion of the orthogonal acceleration-type TOFMS in the present embodiment example. In FIG. 1 and FIG. 2, components identical to those in FIG. 4 explained above will be indicated using the same symbols.

The orthogonal acceleration-type TOFMS in the present embodiment example is furnished with a an ion source 4 that ionizes the components of the target sample, TOF analyzer 2 furnished with a flight space 21 and reflector 22, orthogonal acceleration portion 1 that accelerates ions into the TOF analyzer 2, ion guide 5 that guides ions fired from ion source 4, detector 3 that detects ions arriving thereto that have flown across flight space 21 of TOF analyzer 2, data processor 6 that creates the mass spectrum, etc., by performing data processing of detection signals received from detector 3, orthogonal acceleration power supply portion 7 that applies a designated voltage to each of the plurality of electrodes contained in the orthogonal acceleration portion 1, controller 8 that controls the orthogonal acceleration power supply portion 7, etc., and input portion 9 that performs input settings. Controller 8 includes a mode switching module 81 serving as the functional block. Moreover, other components are also present to apply voltage to the ion guide 5, reflector 22, etc., but notation of these has been omitted from FIG. 1.

As shown in FIG. 2, orthogonal acceleration portion 1 includes a repeller electrode 11 positioned parallel to the X axis direction, which is the direction in which the ion beam is fired, extraction electrode 12 positioned essentially parallel to said repeller electrode 11, and a plurality of acceleration electrodes 13 positioned along the Z axis direction. Acceleration electrodes 13 are ring or cylindrical in shape and rotate symmetrically around central axis C1 extending in the Z axis direction. In the prior-art orthogonal acceleration portion 1 indicated in FIG. 4, the final-stage acceleration electrode 13 is a grid electrode 13*b*, but in the configuration of the present embodiment example, the final-stage acceleration electrode is not a grid electrode, but rather has the same shape as the other acceleration electrodes.

Basic analysis operations in the orthogonal acceleration-type TOFMS in the present embodiment example will be described.

The various types of ions produced by ion source 4 are introduced to orthogonal acceleration portion 1 in the X axis direction while being focused by ion guide 5. Upon introduction of ions to orthogonal acceleration portion 1, an acceleration field has not yet been formed in said orthogonal acceleration portion 1; only at the point in time that an adequate quantity of ions have been introduced to orthogonal acceleration portion 1 is a designated voltage applied to repeller electrode 11, extraction electrode 12 and the plurality of acceleration electrodes 13 by orthogonal acceleration power supply portion 7, thereby forming an extraction field and an acceleration field. Ions are sent from the extraction area to the acceleration area by the action of this extraction field, and the ions are then imparted with kinetic energy in the Z axis direction by the action of the acceleration field, sending them into flight space 21 of TOF analyzer 2.

As indicated by the double-dotted line in FIG. 1, after ions have begun their flight from the acceleration area of orthogonal acceleration portion 1, the ions are folded back by a reflection field formed by reflector 22, finally reaching detector 3. As time passes, detector 3 produces a consecutive detection signal in accordance with the amount of ions that have arrived. Data processor 6 finds the time-of-flight spectrum from the detection signal using as the origin the launch time of the ions, and finds the mass spectrum by then converting time-of-flight to mass-to-charge ratio m/z.

Figure 3:
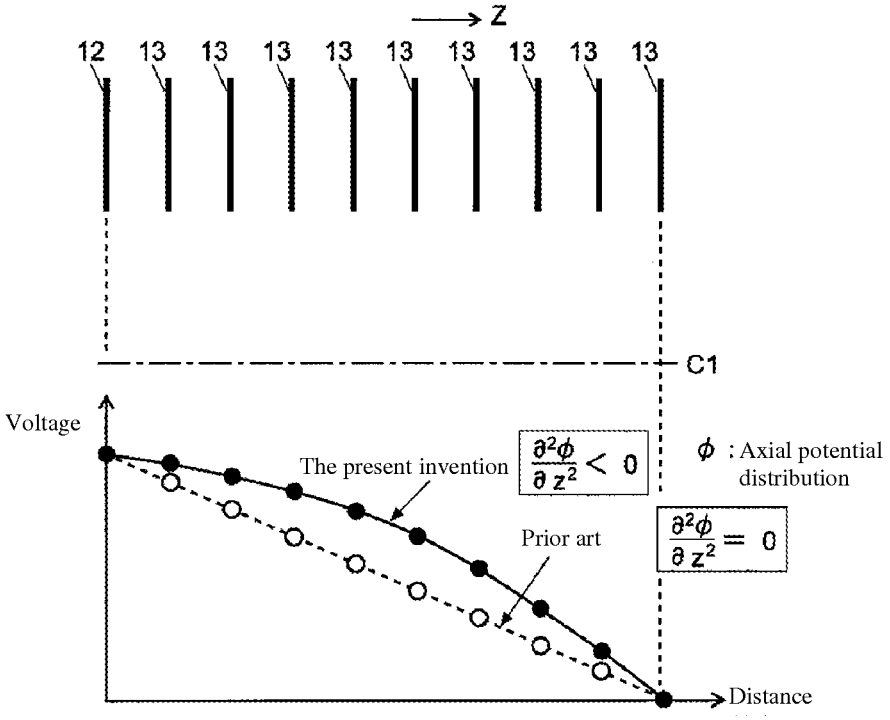
FIG. 3 Schematic view comparing the voltage applied to each of the plurality of accelerating electrodes in the orthogonal acceleration portion of the orthogonal acceleration-type TOFMS in the present embodiment example versus that in a prior-art orthogonal acceleration-type TOFMS.

When performing analysis of the kind described above, orthogonal acceleration power supply portion 7 inputs a designated voltage in pulses at a designated timing to the repeller electrode 11, extraction electrode 12 and plurality of acceleration electrodes 13. FIG. 3 is a schematic view comparing the voltage applied to each of the plurality of accelerating electrodes in the orthogonal acceleration portion of the orthogonal acceleration-type TOFMS in the present embodiment example versus that in a prior-art orthogonal acceleration-type TOFMS. Note that this is an example in which the object of analysis is positive ions.

As shown in FIG. 3, in the prior art, acceleration voltage having a linear downwards gradient in the acceleration direction (i.e. in the Z axis direction) was applied to acceleration electrodes 13 provided at a regular interval. The potential distribution along central axis C1 of the acceleration field formed by this acceleration voltage (axial potential distribution) is also given a linear downwards gradient in the acceleration direction. In short, in principle, axial potential distribution $\phi$ becomes $\partial^2\phi/\partial Z^2=0$, so the acceleration field is a uniform electric field with no change in acceleration.

In contrast, in the orthogonal acceleration-type TOFMS in the present embodiment example, acceleration voltage with a gradually increasing downwards gradient in the acceleration direction is applied to the acceleration electrodes 13 provided at a regular interval. For this reason, the axial potential distribution $\phi$ of the acceleration field becomes $\partial^2\phi/\partial Z^2<0$. The behavior of ions in an acceleration field of this kind can be explained using Laplace's equation, which is commonly used to find the potential distribution of an electrostatic field in space. As Laplace's equation is very well known in theory (see, for example, Non-patent Literature 2), a detailed description will be omitted, and it will be described only in brief here. For the purposes of this description, the acceleration area will be considered as cylindrical coordinates, as the acceleration area is cylindrical in shape.

In an electrostatic acceleration field formed by acceleration electrodes 13, the potential distribution must fulfill Laplace's equation below.

$$(1/r)\{\partial/\partial r(r\partial\phi/\partial r)\}+\partial^2\phi/\partial Z^2=0 \quad (1)$$

Where r is the radial position of a cylindrical coordinate and Z is a position along central axis C1.

If $\partial^2\phi/\partial Z^2=0$, then formula (1) becomes:

$$(1/r)\{\partial/\partial r(r\partial\phi/\partial r)\}=0 \quad (2)$$

This signifies that the potential distribution in the radial direction, since it is not dependent upon Z, is the same at any position along central axis C1. For this reason, force does not act in the radial direction r of ions traversing the acceleration field. In short, in the acceleration field, no force either focusing or dispersing the ions is generated.

In contrast, due to the limitations of formula (1), when $\partial^2\phi/\partial Z^2\neq 0$, it is necessary for the radial potential distribution to change relative to the acceleration direction (Z axis direction) in order to negate this potential change. Finally, if $\partial^2\phi/\partial Z^2<0$, then formula (1) becomes:

$$(1/r)\{\partial/\partial r(r\partial\phi/\partial r)\}=-\partial^2\phi/\partial Z^2>0 \quad (3)$$

In this case, the component in radial direction r is always positive.

The fact that force in radial direction r acts in the central direction is clear from the following formula. Namely, assuming based on Laplace's equation that:

$$(1/r)\{\partial/\partial r(r\partial\phi/\partial r)\}=c(>0) \quad (4)$$

Then, in view of the fact that $\partial\phi/\partial r=0$ when $r=0$ due to the symmetry of the system, integration of formula (4) yields the formula (5) below.

$$\partial\phi/\partial r=c'r \quad (5)$$

The fact that the electric field in the radial direction is $E(r)=-\partial\phi/\partial r$ makes it possible to find formula (6).

$$E(r)=-c'r \quad (6)$$

This formula (6) indicates that centrally directed force acts in the radial direction. Note that an equivalent formula can also be obtained from up to the second-order approximation of formula (20) indicated in Non-patent Literature 2.

Thus, the acceleration field at this time will be a field in which ions situated in a location away from central axis C1 in radial direction r are subjected to force constantly pressing them towards central axis Z. For this reason, ions accelerated by the acceleration field will be focused overall in the X axis direction, i.e. in the drift direction.

Figure 5:
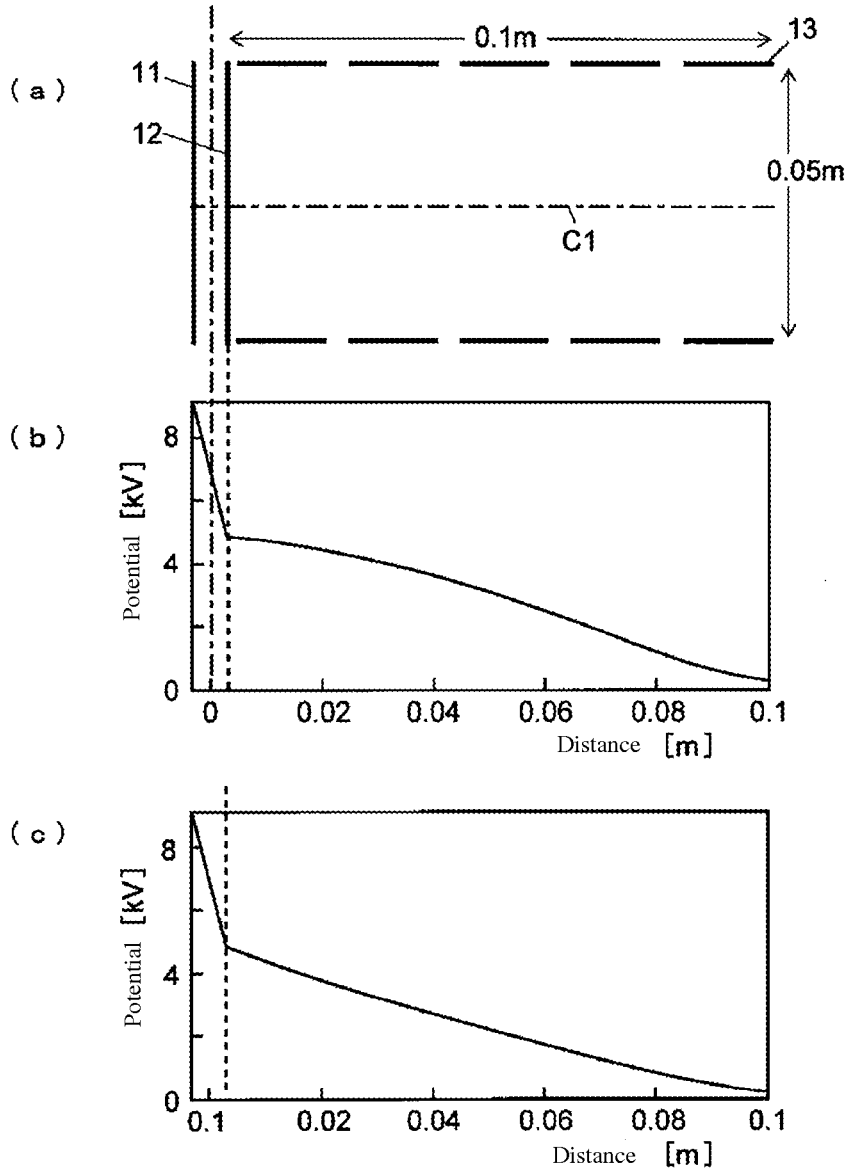
FIG. 5 (a) diagram indicating the electrode model for simulation of the ion trajectory; (b) diagram indicating the axial potential distribution of orthogonal acceleration portion of orthogonal acceleration-type TOFMS in the present embodiment example; and (c) diagram indicating axial potential distribution of orthogonal acceleration portion of a prior-art orthogonal acceleration-type TOFMS.
Figure 6:
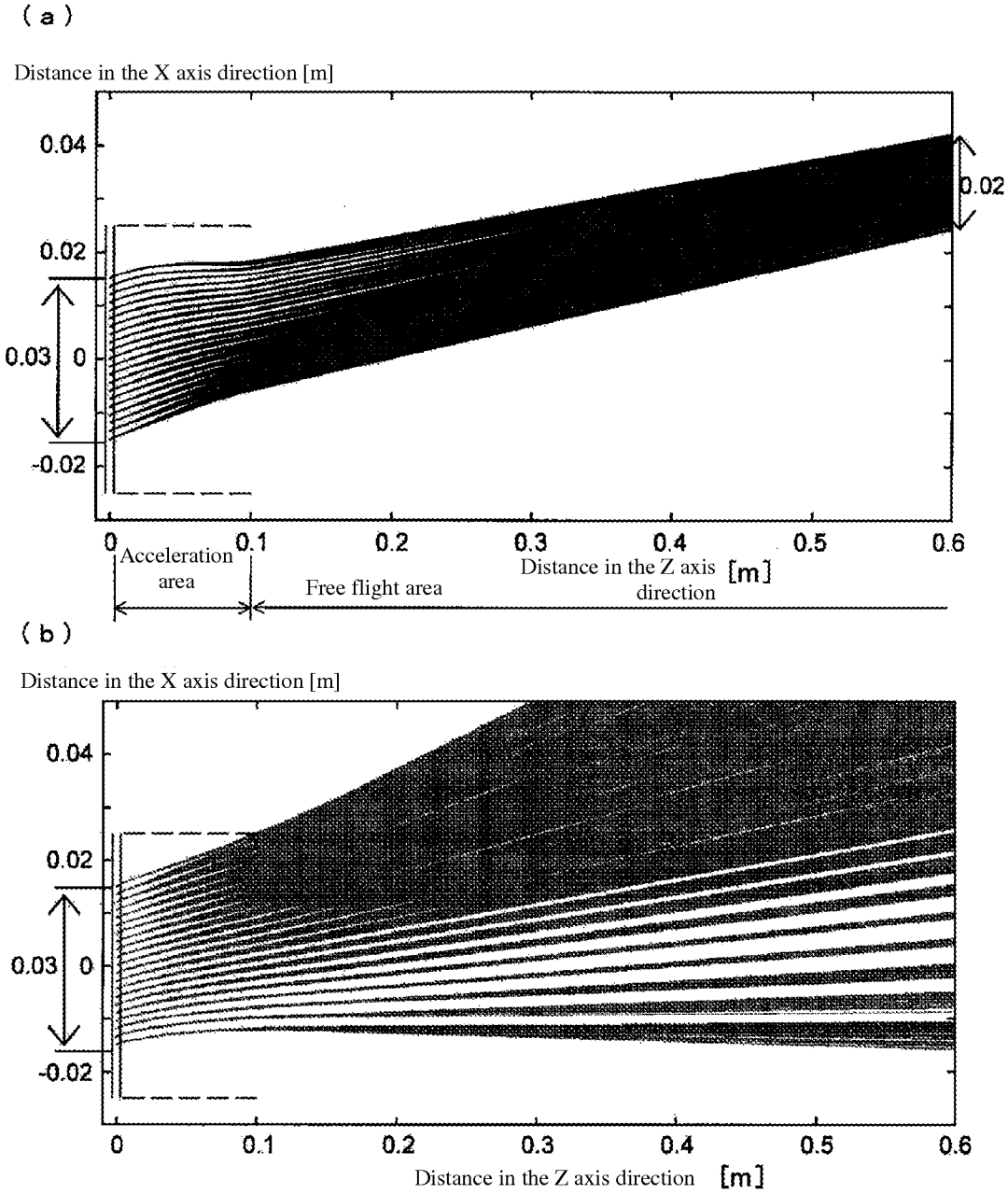
FIG. 6 (a) Diagram indicating the results of a simulation of ion trajectory in the orthogonal acceleration-type TOFMS in the present embodiment example; and (b) diagram indicating the results of a simulation of ion trajectory in a prior-art orthogonal acceleration-type TOFMS.

An ion trajectory simulation performed to verify this ion focusing action will be described below. In FIG. 5, (a) is a diagram indicating the electrode model for simulation of the ion trajectory, (b) is a diagram indicating the axial potential distribution of orthogonal acceleration portion of orthogonal acceleration-type TOFMS in the present embodiment example, and (c) is a diagram indicating the axial potential distribution of the orthogonal acceleration portion of a prior-art orthogonal acceleration-type TOFMS. In FIG. 6, (a) is a diagram indicating the results of a simulation of ion trajectory in the orthogonal acceleration-type TOFMS in the present embodiment example, and (b) is a diagram indicating the results of a simulation of ion trajectory in a prior-art orthogonal acceleration-type TOFMS.

Note that, due to the complexity of making an accurate simulation of the grid electrodes, in this simulation, the grid electrodes were converted to a boundary with no thickness serving only to prescribe an equipotential surface. For this reason, diverger lens action arising from the grid electrodes has not been taken into account.

As shown in FIG. 5 (*a*), during simulation calculation, acceleration electrode 13 was deemed to be a 5-stage cylindrical electrode wherein the overall length of the Z axis direction was 0.1 [m] and the inner diameter was 0.05 [m]. In the orthogonal acceleration-type TOFMS in the present embodiment example, the voltage applied, respectively, to repeller electrode 11, extraction electrode 12 and 5-stage acceleration electrode 13 was 9100, 4900, 4900, 4116, 3136, 1764 and 0 [V]. At this time, as shown in FIG. 5 (*b*), the axial potential distribution was $\partial^2\phi/\partial Z^2<0$ over nearly the full extent of the acceleration area. In contrast, in the prior-art orthogonal acceleration-type TOFMS being compared, the voltage applied, respectively, to repeller electrode 11, extraction electrode 12 and 5-stage acceleration electrode 13 was 9100, 4900, 3920, 2940, 1960, 980 and 0 [V]. At this time, the axial potential distribution was $\partial^2\phi/\partial Z^2=0$ over nearly the full extent of the acceleration area. However, because in both cases, no grid electrode was provided at the exit aperture from the acceleration area, the axial potential distribution in the area nearby was $\partial^2\phi/\partial Z^2>0$.

During simulation calculation, it was assumed that ions were being continuously introduced at a designated energy into the area between repeller electrode 11 and extraction electrode 12, with ion packets having an initial packet width of 30 [mm] being separated from the ion beam extending in the X axis direction and accelerated from the extraction area to the acceleration area after having been separated.

FIG. 6 (*b*) reveals that, under prior-art voltage conditions in which the acceleration field was uniform, ion packets with an initial 30 [mm] width in the drift direction had dispersed significantly by the point in time of having flown 60 [cm]. Because with this extent of ion dispersal, a large proportion of ions will not reach the ion detection surface of the detector, a significant decline in sensitivity is unavoidable. Furthermore, a detector with a large ion detection surface is required in order to catch as many of the dispersed ions as possible, which increases the cost of the detector.

In contrast, FIG. 6 (*a*) reveals that, with the orthogonal acceleration-type TOFMS in the present invention, ion packets with an initial 30 [mm] width in the drift direction had been compressed to a width of 20 [mm] by the point in time of having flown 60 [cm]. This fact confirms that ion focusing is being performed in an effective manner in the acceleration area. Firing focused ions at the detector in this manner thus makes it possible for ions to more efficiently reach the ion detection surface of the detector, which is highly effective in improving sensitivity. Doing this also makes it possible to keep down the cost of the detector, as a small ion detection surface is adequate for the detector.

As evinced by the aforesaid trajectory simulation results, when acceleration voltage in which the downwards gradient increases gradually in the acceleration direction is applied to the acceleration electrodes 13, ion packets focused in the acceleration area are fired into flight space 21, resulting in an increase in the amount of ions entering detector 3 in comparison with when this manner of focusing is not performed. This consequently renders possible high-sensitivity measurement. However, it goes without saying that performing focusing in the acceleration area slightly alters the flight trajectory of many ions, consequently altering the flight distance thereof. This alteration of the flight distance increases the further the initial position of the ion from central axis C1, and the extent of change in flight distance among ions of the same mass-to-charge ratio brings about a decrease in mass resolution. In short, improving measurement sensitivity by focusing ions in the manner set forth above runs the risk of bringing about a decrease in mass resolution.

In view of this, in the orthogonal acceleration-type TOFMS in the present embodiment example, rather than performing ion focusing of the kind described above at all times, the user can choose to focus the ions to improve sensitivity when it is necessary to perform measuring with a particular focus on sensitivity. For this reason, in the orthogonal acceleration-type TOFMS in the present embodiment example, two measurements are provided, namely high-sensitivity measurement mode and high-resolution measurement mode, with measurement in one of either of these modes being possible when so directed by the user by means of input portion 9. Furthermore, by performing analysis automatically according to a method file containing pre-set analysis conditions, it is possible to perform analysis while automatically switching between high-sensitivity measurement mode and high-resolution measurement mode.

In either case, mode switching module 81 in controller 8 specifies the measurement mode to orthogonal acceleration-type power supply portion 7, and in high-sensitivity measurement mode, orthogonal acceleration power supply portion 7 applies voltage that focuses the ions in the acceleration field in the manner set forth above (voltage whose downward gradient increases gradually in the acceleration direction) to each acceleration electrode 13, while in high-resolution measurement mode, orthogonal acceleration power supply portion 7 applies voltage that does not focus the ions in the acceleration field (voltage whose downward gradient is linear in the acceleration direction) to each acceleration electrode 13. Thus, in high-sensitivity measurement mode, more ions reach detector 3 than in high-resolution measurement mode, making it possible to achieve high measurement sensitivity. In contrast, in high-resolution measurement mode, although the amount of ions reaching detector 3 is less compared with high-sensitivity measurement mode, the flight distance of ions with the same mass-to-charge ratio is uniformized, making it possible to achieve high resolution.

Moreover, because the extent of focusing of ions changes depending on the axial potential distribution in the acceleration area, it is also acceptable to set the applied voltage in such a way as to appropriately adjust axial potential distribution according to the TOF analyzer 2 or detector 3 that is used, rather than merely according to switching of measurement mode in the manner set forth above. By so doing, it becomes possible to maintain mass resolution and mass accuracy while increasing measurement sensitivity as much as possible in a variety of configurations of orthogonal acceleration-type TOFMS.

Furthermore, although in the aforesaid embodiment example, an electric field was formed in such a way that the axial potential distribution $\phi$ over the entirety of central axis C of the acceleration area was $\partial^2\phi/\partial Z^2<0$, it is also acceptable to form an electric field in which the axial potential distribution $\phi$ is $\partial^2\phi/\partial Z^2<0$ over at least a portion of central axis C while the axial potential distribution $\phi$ is $\partial^2\phi/\partial Z^2=0$ over the other portions. Naturally, it is clear from the preceding description that, if the final stage of the acceleration area is not a grid electrode, the ion focusing action in the acceleration area must exceed the produced ion diffusion effect.

Furthermore, although in the aforesaid embodiment example ions produced by ion source 4 were introduced to orthogonal acceleration portion 1 through ion guide 5, it is also acceptable to introduce ions discharged by an ion trap or ions separated by a collision cell or the like into orthogonal acceleration portion 1. Furthermore, the orthogonal acceleration-type TOFMS in the present invention can be used in a variety of devices.

For example, a LC-TOFMS device can be formed by connecting a liquid chromatograph in the stage prior to this orthogonal acceleration-type TOFMS, and a GC-TOFMS device can be formed by connecting a gas chromatography in the stage prior to this orthogonal acceleration-type TOFMS.

Furthermore, an LC-IMS-TOFMS device can be formed by connecting a liquid chromatograph to the stage prior to this orthogonal acceleration-type TOFMS and then providing an ion mobility meter between ion source 4 and orthogonal acceleration portion 1. Furthermore, an LC-Q-TOFMS device can be formed by connecting a liquid chromatograph to the stage prior to this orthogonal acceleration-type TOFMS and then providing a quadrupole mass filter and collision cell between ion source 4 and orthogonal acceleration portion 1, and a GC-Q-TOFMS device can be formed by connecting a gas chromatograph to the stage prior to this orthogonal acceleration-type TOFMS and then providing a quadrupole mass filter and collision cell between ion source 4 and orthogonal acceleration portion 1.

Furthermore, it goes without saying that although in the aforesaid embodiment example, the TOF analyzer was a reflectron-type TOF analyzer, it is also acceptable to use another type of TOF analyzer such as a linear type or a multi-turn type.

Finally, it is obvious that the aforesaid embodiment examples and the various variants described above are merely examples of the present invention, and any alterations, corrections, additions, etc. performed thereto that do not deviate from the gist of the present invention fall within the scope of the patent claims.

DESCRIPTION OF REFERENCES

1: Orthogonal acceleration portion
11: Repeller electrode
12: Extraction electrode
13: Acceleration electrode
2: TOF analyzer
21: Flight space
22: Reflector
3: Detector
4: Ion source
5: Ion guide
6: Data processor
7: Orthogonal acceleration power supply portion
8: Controller
81: Mode switching module
9: Input portion

What is claimed is:

1. Orthogonal acceleration-type time-of-flight mass spectrometer, comprising:

a) an orthogonal acceleration portion that accelerates ions introduced therein in a direction orthogonal to the optical axis of the ion beam;

b) a repeller electrode provided parallel to the optical axis of the ion beam;

c) an extraction electrode provided opposite said repeller electrode across from the ion beam, which serves as a grid electrode;

d) a plurality of ring or cylindrical acceleration electrodes that together form the acceleration field that serves to accelerate ions traversing the grid of said extraction electrodes in a direction orthogonal to the optical axis of the aforesaid ion beam by means of the electric field formed between the aforesaid repeller electrode and the aforesaid extraction electrode; and e) a voltage input portion that, towards the aim of producing focusing action on the ions in a direction orthogonal to the direction of acceleration, inputs to each of the aforesaid plurality of acceleration electrodes a voltage determined to form, over at least a portion of the aforesaid acceleration field, an electric field in which the declining gradient of the potential distribution along the central axis of the aforesaid plurality of acceleration electrodes increases gradually in the direction of progress of the ions.

2. Time-of-flight mass spectrometer set forth in claim 1, further comprising a controller is additionally provided to control the aforesaid voltage application portion in such a way as to alter the voltage applied to each of the aforesaid plurality of acceleration electrodes whereby the action of focusing ions in the acceleration field in a direction orthogonal to the direction of acceleration is adjusted.

3. The time-of-flight mass spectrometer set forth in claim 2, wherein the time-of-flight mass spectrometer is able to switch between high-resolution measurement mode prioritizing mass resolution and high-sensitivity measurement mode prioritizing sensitivity, as the aforesaid controller is disposed such that, when high-sensitivity measurement mode is specified, voltage is input to each of the aforesaid plurality of acceleration electrodes in such a way as to form, over at least a portion of the aforesaid acceleration field, an electric field in which the downwards gradient of the potential distribution along the central axis of the aforesaid plurality of acceleration electrodes increases gradually in the direction of progress of the ions, and when high-resolution measurement mode is specified, voltage is input to each of the plurality of acceleration electrodes in such a way as to achieve an electric field in which the potential gradient of the aforesaid potential distribution is uniform.

* * * * *